United States Patent [19]

Reinehr et al.

[11] 4,185,058

[45] Jan. 22, 1980

[54] PROCESS FOR SPINNING HYDROPHILIC ACRYLIC FIBERS WITH IMPROVED COLORING RESPONSE TO DYES

[75] Inventors: Ulrich Reinehr; Toni Herbertz, both of Dormagen; Hermann-Josef Jungverdorben, Grevenbroich, all of Fed. Rep. of Germany

[73] Assignee: Bayer Aktiengesellschaft, Leverkusen, Fed. Rep. of Germany

[21] Appl. No.: 877,318

[22] Filed: Feb. 13, 1978

[30] Foreign Application Priority Data

Feb. 16, 1977 [DE] Fed. Rep. of Germany ..... 2706522

[51] Int. Cl.[2] ..... B29H 7/20; D01F 6/18

[52] U.S. Cl. ..... 264/49; 264/203; 264/205; 264/206; 264/211; 264/344

[58] Field of Search ..... 264/206, 49, 203; 428/343, 398, 373, 376, 774

[56] References Cited

U.S. PATENT DOCUMENTS 3,879,506 4/1975 Malacini et al. ..... 264/49

FOREIGN PATENT DOCUMENTS 2607071 8/1977 Fed. Rep. of Germany ..... 264/206
46-5207 2/1971 Japan ..... 264/182
51-66363 6/1976 Japan ..... 264/206

*Primary Examiner*—Jay H. Woo
*Attorney, Agent, or Firm*—Sprung, Felfe, Horn, Lynch & Kramer

[57] ABSTRACT

The invention relates to hydrophilic fibers and filaments with good coloring response to dyes from filament-forming hydrophobic synthetic polymers having a sheath-core structure with a highly microporous core and a substantially compact sheath and having a water retention capacity of at least 10% wherein the pores in the core have an average pore diameter measured in the direction of the cross-section of the fiber, of at most 4000 Å. The invention relates also to a process for the production of those filaments and fibers according to a dry-spinning process wherein a spinning solution is spun below the boiling point of the spinning solvent used.

9 Claims, No Drawings

PROCESS FOR SPINNING HYDROPHILIC ACRYLIC FIBERS WITH IMPROVED COLORING RESPONSE TO DYES

It has already been proposed to produce hydrophilic filaments and fibres from filament-forming synthetic polymers by adding to the spinning solvent from 5 to 50% by weight, based on the quantity of solvent and solids, of a substance which is essentially a non-solvent for the polymer and which is readily miscible with the spinning solvent, and then removing this non-solvent from the resulting filaments. Preferred non-solvents for this process are polyhydric alcohols such as glycerol and glycols.

Filaments and fibres which have been spun by this method, for example from acrylonitrile polymers, have a core-and-sheath structure in which the core is highly microporous and the sheath is substantially compact, and they have a water retention capacity of at least 10%. The higher the proportion by weight of non-solvent added, the better are the hydrophilic properties of the filaments.

When filaments are produced by the dry-spinning process at the usual temperatures of the duct and of the air above the boiling point of the spinning solvent which is to be evaporated, electron-microscopic photographs of cross-sections and longitudinal sections of the filaments show that the pores in the core have an average diameter of approximately 4000 to 8000 Å while the sheath depending on the after-treatment process, is substantially compact, i.e. it has much smaller pores, e.g. with diameters in the region of about 200 to 800 Å.

Core-and-sheath fibres which have these structural features have excellent hydrophilic characteristics, but pores with diameters greater than about 4000 Å produce pronounced light scattering effects in the dyeing process and hence considerable lightening of the colour. These hydrophilic, porous acrylic fibers therefore require more dye to produce a given depth of colour than ordinary, substantially non-porous fibres.

It has now surprisingly been found that hydrophilic, porous core-and-sheath fibres which have good dyeing properties can be obtained by altering the thermal conditions during the spinning process.

It is therefore an object of this invention to improve the dyeability of sheath/core fibres having a microporous core.

It is another object of the present invention to reduce the size of the pores in the core of sheath/core fibres having a porous core.

These and other objects which will be evident from the following description and the examples will be accomplished by a process for the production of hydrophilic fibres and filaments with good colouring response to dyes from filament-forming hydrophobic synthetic polymers having a core-and-sheath structure with a highly microporous core and a substantially compact sheath and having a water retention capacity of at least 10%, and with pores in the core having an average pore diameter measured in the direction of the cross-section of the fibre, of at most 4000 Å, by dry-spinning in a spinning duct and spinning air a solution which, in addition to a suitable solvent contains from 5 to 50% by weight, based on the quantity of solvent and polymer, of an essentially non-solvent for the polymer which is readily miscible with the spinning solvent at a temperature below the boiling point of the spinning solvent used and subsequently removing the non-solvent, spinning said solution.

Deeply dyeing hydrophilic fibers and filaments are obtained by this process from filament-forming synthetic polymers. These fibers and filaments have a core-and-sheath structure with a highly microporous core and a substantially compact sheath. They have a water retention capacity of at least 10% and are characterised by the fact that the pores in the core have an average pore diameter of at the most 4000 Å measured in the direction of the cross-section of the fibre.

According to the invention preferably acrylonitrile polymers are spun and among these, those are preferred which contain at least 50% by weight, most preferably at least 85% by weight, of acrylonitrile units.

The spinning solvents used may be any of the solvents commonly used for dry spinning, e.g. dimethyl acetamide, dimethyl sulphoxide or N-methylpyrrolidone, but dimethyl formamide is preferred.

The non-solvents added to the spinning solvent most preferably have a boiling point which is 50 degrees centigrade or more above that of the solvent. The non-solvent must be miscible both with the solvent and with water or any other liquid used as washing liquid in the after-treatment process for the filaments, and should preferably be miscible with these liquids in any proportion. The term "non-solvent" in the context of this invention means any substance which for practical purposes can be said not to dissolve the polymer used or only to dissolve it to a very slight extent.

Such substances include, for example, mono- and poly-substituted alkyl ethers and esters of polyhydric alcohols, e.g. diethylene glycol monomethyl, dimethyl, ethyl and butyl ethers, diethylene glycol, triethylene glycol, tripropylene glycol, triethylene glycol diacetate, tetraethylene glycol, tetraethylene glycol dimethyl ether, and glycolether acetates such as butyl glycol acetate. High boiling alcohols such as 2-ethylcyclohexanol and esters or ketones or mixtures thereof e.g. of ethylene glycol acetates, are also suitable. Glycerol and/or tetraethylene glycol are referably used.

The spinning process is in principle a conventional dry-spinning process carried out from highly polar organic solvents, preferably dimethyl formamide (DMF), but the process according to the invention is carried out at lower duct temperatures and air temperatures. In a conventional dry-spinning process, the temperature of the spinning duct and preferably also the air temperature are above the boiling point of the spinning solvent used. In the process according to the present invention, however, the duct temperatures and preferably also the air temperatures employed are below the boiling point of the spinning solvent.

By this method it is quite unexpectedly possible to produce pores in the core of the core-and-sheath fibres having an average pore diameter, measured in the direction of the fibre cross-section, of up to about 4000 Å, preferably about 1000 to 2000 Å.

The sheath of these core-and-sheath fibres is substantially compact, i.e. compared with the core it has virtually no optically visible cavities.

Production of the filaments by this process according to this invention may be carried out as follows:

The temperature of the spinning solution containing the non-solvent should be at least about 80° C., preferably from 120° to 150° C. At this temperature the spinning solution is spun into a spinning duct which is at a temperature below the boiling point of the spinning solvent used. When DMF is used as spinning solvent, the maximum spinning duct temperature is 150° C. and preferably in the range of from about 20° C. to about 100° C.

The temperature of the spinning air may be up to 200° C. but spinning air temperatures of from 50° to 150° C. are preferred. The quantity of spinning air required to achieve sufficient strengthening of the filaments in the spinning duct depends, of course, on the temperature conditions employed. It can be determined in each individual case by simple tests. For a cylindrical spinning duct 400 cm in length and 30 cm in diameter, it has been found suitable to supply spinning air at the rate of at least 10 $m^3$ per hour, preferably at least 40 $m^3$ per hour.

The spun core-and-sheath fibres produced as described above are then washed, stretched and dried by the usual methods. Fibres and filaments produced in this way have a good capacity to be coloured by dyes, comparable to that of conventional acrylic fibres.

In the following Examples which are to further illustrate the invention without limiting it, parts and percentages are parts and percentages by weight unless otherwise indicated.

EXAMPLE 1

52 kg of dimethyl formamide (DMF) were mixed with 12 kg of tetraethylene glycol in a vessel with stirring. 36 kg of an acrylonitrile copolymer of 93.6% of acrylonitrile, 5.7% of methyl acrylate and 0.7% of sodium methallyl sulphonate were then added with stirring at room temperature. The suspension was heated to 135° C. in a heating apparatus. After leaving the heating apparatus, the spinning solution was filtered and transferred to the spinning duct. The total residence time of the suspension, from the heating apparatus to the spinneret, was approximately 5 minutes.

The spinning solution was dry spun from a 72-bore spinneret. The temperature of the duct was 30° C. and the air temperature 40° C. The quantity of air supplied was 40 $m^3$ per hour. The fibrous material, which had a denier of 2440 dtex, was collected on bobbins and doubled to form a tow with an overall denier of 1,708,000 dtex. The tow was then drawn in a ratio of 1:4.0 in boiling water, washed, treated with an antistatic dressing and dried under conditions permitting 20% shrinkage. It was then crimped and cut up into staple fibres 100 mm in length. The individual fibres, which had a final denier of 11 dtex, had a water retention capacity according to DIN 53 814 of 49%. They had a pronounced core-and-sheath structure. The cross-sectional surface area of the sheath amounted to approximately 5% of the total cross-sectional area. The average pore diameter was approximately 1000 Å and the internal surface area, measured by the BET-method, was 57.1 ($m^2/g$).

Assessment of colouring response to dyeing

The fibres were dyed in a concentration series ranging from 0.1–4% of a blue dye represented by the following formula:

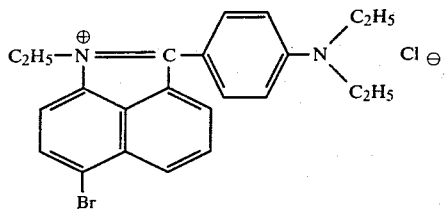

A commercial dry-spun acrylic fibre of the same denier and the same composition was used for comparison. The dyeings obtained were assessed visually and compared with each other by remission measurements. The additional amount of dye used, compared with that used by the ordinary commercial acrylic fibres, was 40%.

EXAMPLE 2

(a) The spinning solution from Example 1 was spun as described in that Example but at a duct temperature of 100° C. and an air temperature of 50° C.

The fibrous material was then collected on bobbins and doubled as described in the Example and after-treated to produce fibres with a final denier of 11 dtex. The water retention capacity of the fibres was 37%. The fibres again had a pronounced core-and-sheath structure. The cross-sectional surface area of the sheath amounted to approximately 10% of the total cross-sectional area. The average pore diameter, determined from a cross-sectional electron microscopic photograph, was found to be approximately 1400 Å, and the internal surface area was 48 ($m^2/g$).

The colouring response to dyeing was determined by means of a concentration series carried out as described in Example 1 and using the same dye. The additional amount of dye used, compared with that of a commercial acrylic fibre, was 60%.

(b) When the air temperature in the spinning process was raised to a maximum of 200° C., core-and-sheath fibres having approximately the same pore structure and hydrophilic character were again obtained. The additional amount of dye used by the fibres, compared with commercial fibres, was again 60%. When the air temperature was raised to 300°–400° C., the colouring response to the core-and-sheath fibres obtained was further reduced. The additional amount of dye required by the fibres, compared with commercial fibres, was then 75%.

EXAMPLE 3

60 kg of DMF were mixed with 10 kg of glycerol in a vessel with stirring. 30 kg of an acrylonitrile copolymer having the chemical composition indicated in Example 1 were added at room temperature with stirring and the suspension was dissolved as described in Example 1, filtered and spun from a 288 bore spinneret at a duct temperature of 44° C. and an air temperature of 60° C. The fibrous material, with a denier of 2150 dtex, was collected on bobbins, doubled and after-treated as described in Example 1 to produce fibres with a final denier of 2.5 dtex. The water retention capacity of the core-and-sheath fibres was 47%. The cross-sectional surface area of the sheath amounted to approximately 5% of the total cross-sectional area of the fibres. The average pore diameter was approximately 800 Å and the internal surface area was 34.5 ($m^2/g$).

Colouring response to dyeing: The additional amount of dye required, compared with that of conventional dry-spun acrylic fibres, was 45%.

EXAMPLE 4

61 kg of DMF were mixed with 9 kg of water in a vessel with stirring. 30 kg of an acrylonitrile copolymer having the chemical composition indicated in Example 1 were added at room temperature with stirring and the suspension was heated, dissolved and filtered as described in Example 1. The spinning solution was dry-spun from a 90-bore spinneret at a duct temperature of 80° C. and an air temperature of 150° C. The quantity of air used was 40 $m^3$ per hour. The spun fibrous material having a denier of 1020 dtex was collected on bobbins, doubled and aftertreated as described in Example 1 to produce fibres with a final denier of 3.3 The dtex. The individual fibres had a water retention capacity of 24%. They again had a core-and-sheath structure, and the cross-sectional surface area of the sheath amounted to approximately 12% of the total cross-sectional surface area. The average pore diameter was approximately 1200 Å and the internal surface area was 16 ($m^2$/g).
Colouring response to dyeing: Additional quantity of dye required, compared with that of conventional acrylic fibres: 55%.

EXAMPLE 5 (Comparison)

DMF and tetraethylene glycol were added to an acrylonitrile copolymer as described in Example 1 and the mixture was dissolved, filtered and again spun from a 72-bore spinneret. The temperature of the duct was 160° C. and the air temperature was 250° C. The spun fibrous material was aftertreated to produce fibres with a final denier of 11 dtex as described in Example 1. The water retention capacity of the fibres was 54%. The fibres again had a core-and-sheath structure. The cross-sectional surface area of the sheath amounted to approximately 18% of the total cross-sectional area. The average pore diameter was in the region of 4000–8000 Å and the internal surface area was 27 ($m^2$/g).
Colouring response to dyeing: Additional amount of dye required, compared with that of conventional acrylic fibres: 170%.
When the air temperature was raised to a maximum of 400° C., there was no substantial change in the hydrophilic character, pore size or colouring response of the fibres.

EXAMPLE 6 (Comparison)

DMF and tetraethylene glycol were added to an acrylonitrile copolymer as described in Example 1 and the mixture was dissolved, filtered and spun at a duct temperature of 30° C. and an air temperature of 40° C. as indicated in Example 1. The quantity of air used was 2 $m^3$ perhour. After only a short time, condensed DMF dripped from the end of the duct causing the fibres on the bobbins to stick. The spinning process began to improve at an air supply rate of 10 $m^3$ per hour and was trouble-free at 40 $m^3$ per hour. Condensation of spinning solvent at the end of the duct ceased completely.

What we claim is:

1. A process for the production of hydrophilic fibers and filaments with good coloring response to dyes, having a core-and-sheath structure with a highly microporous core and a substantially compact sheath and having a water retention capacity of at least 10%, and with pores in the core having an average pore diameter, measured in the direction of the cross-section of the fiber, of at most 4000 Å, comprising dry-spinning, in a spinning duct and spinning air, a solution of a hydrophobic filament forming synthetic polymer, a suitable solvent and from 5 to 50% by weight, based on the quantity of solvent and polymer, of an additive which is essentially a non-solvent for the polymer and which is readily miscible with the spinning solvent, said spinning conducted at a duct temperature below the boiling point of the spinning solvent used.

2. The process of claim 1, wherein said polymer is an acrylonitrile polymer.

3. The process of claim 2, wherein said acrylonitrile polymer consists of at least 50% by weight of acrylonitrile units.

4. The process of claim 1, wherein said spinning solvent is dimethyl formamide.

5. The process of claim 4, wherein the temperature of said spinning duct is at most 150° C.

6. The process of claim 1, in which the duct temperature and the air temperature are below the boiling point of said spinning solvent.

7. The process of claim 1, in which said non-solvent additive has a boiling point of 50° C. or more above said spinning solvent.

8. The process of claim 1, in which said synthetic polymer is an acrylonitrile polymer containing at least 50% by weight of acrylonitrile units, said spinning solvent is dimethyl formamide and the temperature in the spinning duct is at most 150° C.

9. The process of claim 1, in which said hydrophilic fibers and filaments produced have superior coloring response to dyes compared to fibers and filaments of the same synthetic polymers produced identically except that the duct temperature is above the boiling point of the spinning solvent.

* * * * *